US005794766A

United States Patent [19]

Morita et al.

[11] Patent Number: 5,794,766

[45] Date of Patent: *Aug. 18, 1998

[54] ROTARY SWITCH

[75] Inventors: Kozo Morita; Shigeaki Kinoshita; Katsuyuki Tame; Osamu Nomura, all of Tokyo, Japan

[73] Assignee: Teikoku Tsushin Kogyo Co., Ltd., Kawasaki, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 694,325

[22] Filed: Aug. 8, 1996

[30] Foreign Application Priority Data

Aug. 8, 1995 [JP] Japan ..... 7-224666
Dec. 28, 1995 [JP] Japan ..... 7-353964

[51] Int. Cl.[6] ..... H01H 19/20

[52] U.S. Cl. ..... 200/569; 200/568

[58] Field of Search ..... 200/569, 568, 200/564, 11 R, 567, 566, 565, 570

[56] References Cited

U.S. PATENT DOCUMENTS 2,876,313 3/1959 Dull et al. ..... 200/569
2,967,215 1/1961 Whiting ..... 200/569
2,970,199 1/1961 Dull et al. ..... 200/569
3,719,788 3/1973 Holland et al. ..... 200/569
4,625,084 11/1986 Fowler et al. .
5,315,077 5/1994 Simon et al. ..... 200/569
5,422,448 6/1995 Nakano et al. .

*Primary Examiner*—David J. Walczak
*Attorney, Agent, or Firm*—Wenderoth, Lind & Ponack, L.L.P.

[57] ABSTRACT

A rotary switch includes a contact forming member including a switch contact and a land contact and an elastic plate including a base portion mounted on the land contact and an abutment portion disposed above the switch contact. A rotor is disposed above the elastic plate for pivotal movement and includes depresser portions provided in the lower surface of the rotor for depressing the elastic plate. When the rotor is rotated, the depresser portions of the rotor cause the elastic plate to be depressed, so that the abutment portion is engaged with the switch contact.

The contact forming member may be constructed by forming the switch contact and the land contact on a circuit substrate.

The contact forming member may be constructed by a metal plate on which the switch contact is formed, a metal plate on which the land contact is formed, and a stationary member on which the metal plates are secured.

4 Claims, 13 Drawing Sheets

ROTARY SWITCH

BACKGROUND OF THE INVENTION

The invention relates to a rotary switch constructed to be switched ON and OFF by means of rotation of a rotor.

Conventional rotary switches include any of the following constructions.

1. A construction in which a switch pattern is formed on a circuit substrate. An elastic plate of a metal material is mounted to a rotor disposed on the circuit substrate. The elastic plate is engaged with the circuit substrate. When the rotor is rotated, the elastic plate is slidably engaged with the switch pattern, whereby ON-OFF operation of the switch is caused.
2. A construction in which, contrary to the above construction, a switch pattern is formed on a rotor. An elastic plate of a metal material is secured to another member. The elastic plate is engaged with the switch pattern on the rotor. When the rotor is rotated, the elastic plate is slidably engaged with the switch pattern, whereby ON-OFF operation of the switch is caused.

It is noted, however, that, if it is intended to generate two kinds of ON-OFF signals from the rotary switch according to the above construction 1 or 2, two kinds of ON-OFF switch patterns disposed on two circular loci and a common switch pattern of a ring-shaped configuration are required. That is to say, it is necessary to provide a single common switch pattern with which the elastic plate is always engaged, and two ON-OFF switch patterns relative to which the elastic plate is repeatedly engaged and disengaged. Such three switch patterns should be arranged in a concentric relationship.

The above-mentioned conventional rotary switches experience the following problems.

1. The elastic plate is slidably moved on the switch patterns. Thus, wearing of the elastic plate and the switch patterns is increased, thus durability of the rotary switch may not be increased.
2. The elastic plate is always resiliently engaged with the member on which the switch patterns are formed. Thus, a force with which the elastic plate is engaged with the switch patterns may be reduced during use.

When it is intended to generate two kinds of ON-OFF signal, three switch patterns should be provided, as mentioned above. Thus, an increased area is required for the member on which such switch patterns are formed. Accordingly, miniaturization of the rotary switch could not be facilitated.

SUMMARY OF THE INVENTION

Accordingly, the main object of the invention is to provide a rotary switch which may reduce wearing of the elastic plate or a switch pattern, which may prevent reduction in the resilient force during use with which the elastic plate is engaged with the switch pattern, and which may be miniaturized.

In accordance with the invention, a rotary switch is provided which comprises a contact forming member including a switch contact and a land contact, an elastic plate including a base portion mounted on the land contact and an abutment portion disposed above the switch contact, and a rotor disposed above the elastic plate for pivotal or movement and including depresser portions provided in the lower surface of the rotor for depressing the elastic plate, whereby, when the rotor is rotated, the depresser portions of the rotor cause the elastic plate to be depressed, so that the abutment portion is engaged with the switch contact.

DESCRIPTION OF THE PREFERRED EMBODIMENT

Several embodiments of the invention will be explained in detail below with reference to the attached drawings.

Figure 1:
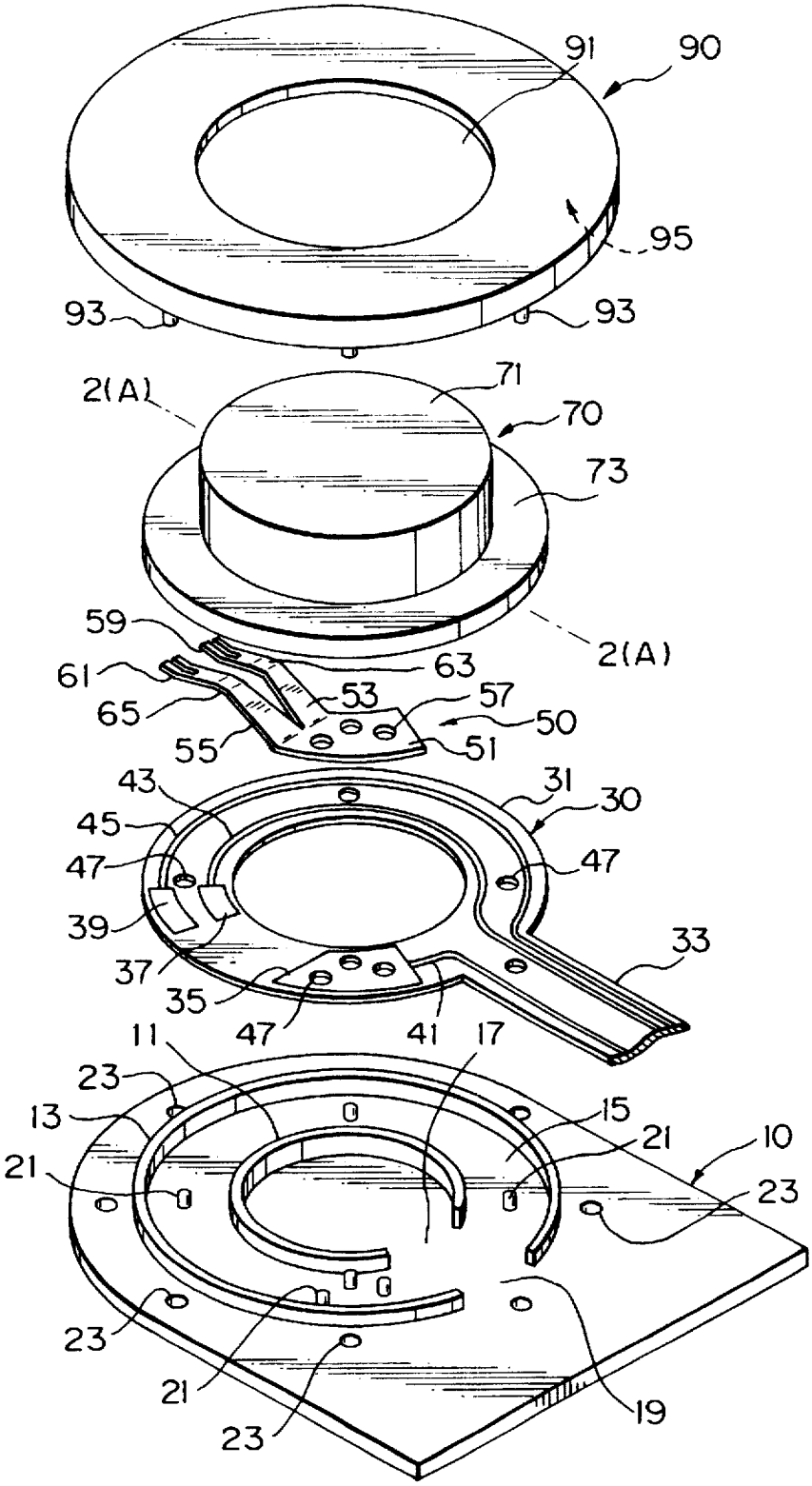
FIG. 1 is an exploded perspective view illustrating a rotary switch according to a first embodiment of the invention.

FIG. 1 is an exploded perspective view illustrating a rotary switch (an incremental encoder for two-phase output) according to a first embodiment of the invention. The rotary switch includes, as shown in FIG. 1, a mounting plate 10, a circuit substrate 30 and an elastic plate 50. The circuit substrate 30 and the elastic plate 50 are secured to the mounting plate 10. The circuit substrate 30 is provided with switch contacts 37, 39 and a land contact 35 (these contacts 37, 39 and 35 constituting a contact forming member). A rotor 70 is placed on the circuit substrate 30. A cover 90 is attached to the rotor 70. Each of these components will be explained below.

The mounting plate 10 is a plate of a synthetic resin material. The mounting plate 10 is provided in its upper surface with an arcuate inner protrusion 11 and an arcuate outer protrusion 13. The inner and outer protrusions are arranged in a concentric relationship. A mounting surface 15 for the substrate (referred to as "substrate mounting surface" hereinbelow) is formed between the inner protrusion 11 and the outer protrusion 13.

The inner protrusion 11 and the outer protrusion 13 are formed with respective notches 17 and 19. An extension 33 (to be explained below) of the circuit substrate 30 extends through the notches. The substrate mounting surface 15 is formed, at predetermined positions thereof, with six small protrusions 21.

A plurality of through-holes 23 are formed in the surface of the mounting plate 10 at predetermined positions outward of the outer protrusion 13. The through-holes 23 are arranged so as to enclose the outer protrusion 13.

The circuit substrate 30 is a sheet of a synthetic resin material (for example, a PET sheet) and includes ring portion 31 of an annular configuration and the extension 33 of a belt-like configuration extending from one end of the ring portion 31. The land contact 35 and the two switch contacts 37 and 39 are formed in the upper surface of the ring portion 31 at predetermined positions. Circuit patterns 41, 43 and 45 leading from the respective contacts 35, 37 and 39 all are extended into the extension 33. The forward end of the extension 33 is not shown the drawings.

It is noted that the ring portion 31 is so sized as to be accommodated within the area of the substrate mounting surface 15.

Each of the land contact 35 and the switch contacts 37 and 39 is formed from a silver paste covered with a carbon conductor. Each of the circuit patterns 41, 43 and 45 is formed from a silver paste covered with an insulating layer.

The circuit substrate 30 is provided with apertures 47. These apertures 47 are arranged so as to be opposed to the respective small protrusions 21, whereby the small protrusions 21 may be extend through the respective apertures 47.

The elastic plate 50 is formed from an elastic metal plate. The elastic plate 50 includes a planar base portion 51, and two arm portions 53 and 55 protruding from one end of the base portion 51.

The base portion 51 is formed with three apertures 57 through which respective three small protrusions 21 on the mounting plate 10 may be extended.

The arm portions 53 and 55 are bent upwardly at an angle from the base portion 51, and then bent downwardly at an angle. The arm portions 53 and 55 include abutment portions 59 and 61, respectively, at their respective forward ends. It is noted that the convex portions at the center of the arm portions 53 and 55, respectively, are referred to as presser portions 63 and 65.

Figure 2A:
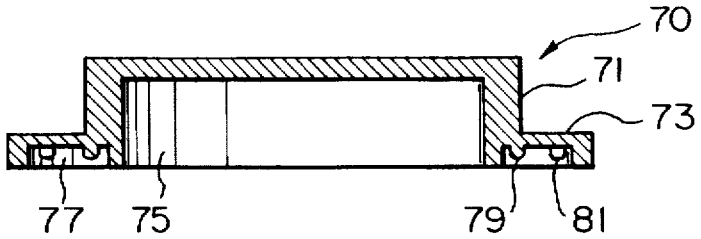
FIG. 2(A) is a sectional view along line 2(A)—2(A) of FIG. 1 showing a rotor 70.
Figure 2B:
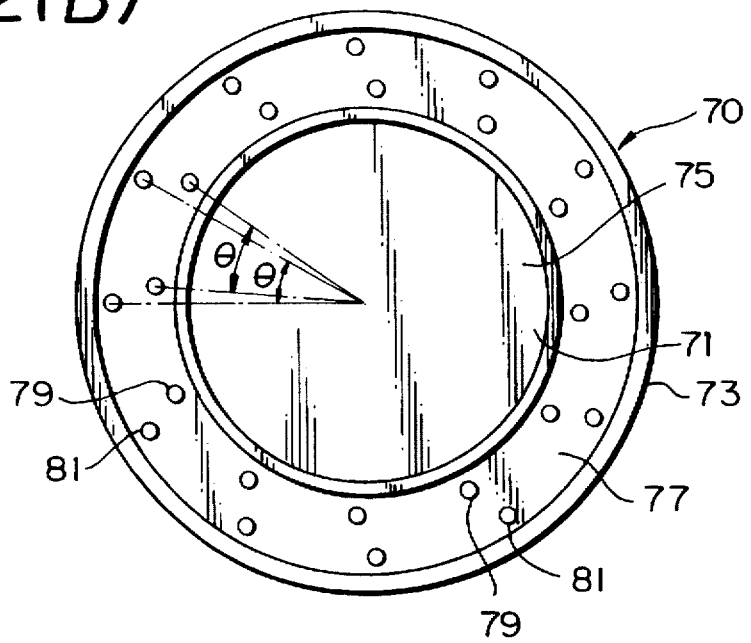
FIG. 2(B) is a rear view of the rotor 70.

FIGS. 2(A) and 2(B) both show the rotor 70. FIG. 2(A) is a sectional view along line 2(A)—2(A) of FIG. 1, and FIG. 2(B) is a rear view of the rotor 70.

As shown in FIGS. 1 and 2(B), the rotor 70 includes a knob portion 71 of a circular configuration, and a flange portion 73 of an annular configuration extending around the periphery of the knob portion 71. A recess 75 of a circular configuration is formed below the knob portion 71. A recess 77 of an annular configuration is formed below the flange portion 73.

Twelve pairs of depresser portions 79 and 81 are protrudingly formed in the recess 77, as shown in FIG. 2(B). Each pair of depresser portions 79 and 81 is arranged at the same angle of rotation (theta=30 degrees) about the pivot center of the rotor 70. Each pair of depresser portions 79 and 81 are arranged so that their phases are slightly shifted.

The cover 90 is formed from a synthetic resin plate of a substantially circular configuration, as shown in FIG. 1. The cover 90 is formed with a circular aperture 91 at its center. The cover 90 is also formed, in its lower surface, with small protrusions 93 arranged to be opposed to the respective through-holes 23 in the mounting plate 10. It is noted that the cover 90 includes in its lower surface a recess 95 for accommodating the flange portion 73 of the rotor 70 and the like therein.

When the rotary switch is to be assembled, the ring portion 31 of the circuit substrate 30 is first placed on the substrate mounting surface 15 of the mounting plate 10. At this time, the small protrusions 21 on the mounting plate 10 are inserted into the respective apertures 47 in the ring portion 31.

Then, the base portion 51 of the elastic plate 50 is placed on the land contact 35 on the circuit substrate 30. At this time, the three small protrusions 21, having passed through the respective apertures 47 in the circuit substrate 30, are inserted into the three respective apertures 57 in the base portion 51.

With the above condition, the forward end of each of the small protrusions 21 on the mounting plate 10 is heat-crimped. By this, the circuit substrate 30 and the elastic plate 50 are secured together in a unitary fashion.

At this time, the two abutment portions 59 and 61 of the elastic plate 50 are disposed above the two switch contacts 37 and 39 on the circuit substrate 30 at a respective predetermined distance.

Then, the rotor 70 is placed on the circuit substrate 30. At this time, the outer periphery of the flange portion 73 of the rotor 70 is accommodated within the outer protrusion 13 of the mounting plate 10.

The cover 90 is placed over the rotor 70. By this, the knob portion 71 of the rotor 70 is protruded upwardly through the aperture 91 in the cover 90. At the same time, the small protrusions 93 in the lower surface of the cover 90 are inserted into the respective through-holes 23 in the mounting plate 10. The forward end of each of the small protrusions 93 is heat-crimped to the lower surface of the mounting plate 10.

Figure 3:
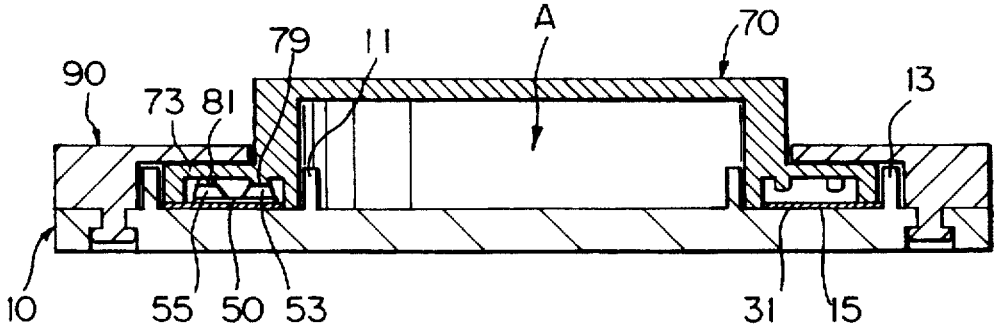
FIG. 3 is a schematic side elevational view in section of the rotary switch.

FIG. 3 is a schematic side elevational view in section of the rotary switch assembled in the above procedure. As shown in FIG. 3, the ring portion 31 of the circuit substrate 30 is placed on the substrate mounting surface 15 of the mounting plate 10. The elastic plate 50 is fixedly secured to the ring portion 31. The flange portion 73 of the rotor 70 is disposed on the ring portion 31. The cover 90 is placed on the flange portion 73.

The two arm portions 53 and 55 of the elastic plate 50 are so positioned that the depresser portions 79 and 81 of the rotor 70 may be in abutment with the arm portions 53 and 55.

It is noted that, although other functional parts are accommodated within the central space A of the rotary switch, such parts will not be explained in the specification, since they do not constitute any part of the invention.

When the rotor 70 is rotated, the depresser portions 79 and 81 of the rotor 70 are successively engaged with the respective arm portions 53 and 55 of the elastic plate 50 at a small phase difference.

Figure 4:
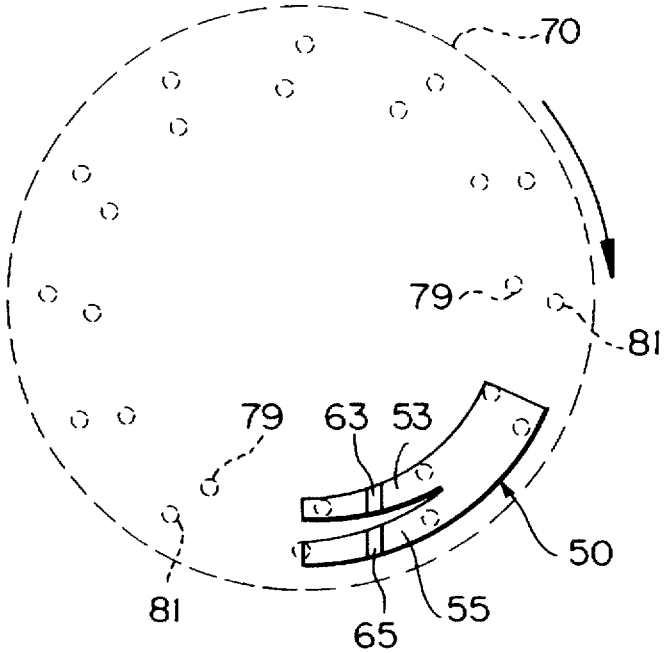
FIG. 4 is a schematic plan view illustrating a positional relationship between arm portion 53, 55 of an elastic plate 50 and depresser portions 79, 81 of the rotor 70.
Figure 5:
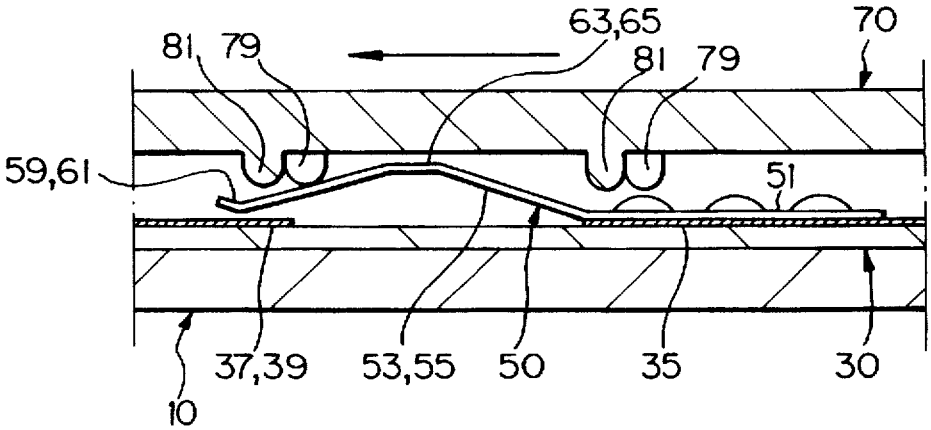
FIG. 5 is a schematic enlarged view in section of main part of the rotary switch illustrating a positional relationship between the arm portions 53, 55 of the elastic plate and the depresser portions 79, 81 of the rotor 70.

FIG. 4 is a schematic plan view illustrating a positional relationship between the arm portions 53 and 55 of the elastic plate 50 and the depresser portions 79 and 81 of the rotor 70. FIG. 5 is an enlarged side elevational view of the main portion of the rotary switch illustrating a positional relationship between the arm portions 53 and 55 of the elastic plate 50 and the depresser portions 79 and 81 of the rotor 70.

When the rotor 70 is rotated in the clockwise direction (in the direction of the arrow in FIG. 4), the presser portions 79 and 81 formed in the lower surface of the rotor 70 are also rotated in the clockwise direction, so as to be passed by the arm portions 53 and 55 of the elastic plate 50 in order.

When the depresser portion 79 passes by the arm portion 53, the same depresser portion 79 becomes engaged with the presser portion 63 of the arm portion 53, to thereby depress the presser portion 63 downwardly. By this, the abutment portion 59 (refer to FIG. 5) at the forward end of the arm portion 53 becomes resiliently engaged with the switch contact 37 provided on the circuit substrate 30, whereby the circuit patterns 41 and 43 shown in FIG. 1 are switched on.

Similarly, when the other depresser portion 81 passes by the arm portion 55, the same depresser portion 81 becomes engaged with the presser portion 65 of the arm 55, to thereby depresses the presser portion 65 downwardly. By this, the abutment portion 61 (refer to FIG. 5) at the forward end of the arm portion 55 becomes resiliently engaged with the switch contact 39, whereby the circuit patterns 41 and 45 shown in FIG. 1 are switched on.

Since the two depresser portions 79 and 81 are arranged so as to be slightly shifted relative to one another in the circumferential direction of the rotor 70, the depresser portions 79 and 81 are engaged with the respective presser portions 63 and 65 of the arm portions 53 and 55 at a slightly different timing, when the rotor 70 is rotated.

More specifically, and when the rotor 70 is continuously rotated in the direction of the arrow in FIG. 4, the timing in which the depresser portion 81 of the pair of depresser portions 79 and 81 is engaged with the presser portion 65 of the arm portion 55 is slightly in advance to the timing in which the depresser portion 79 of the same pair of depresser portions 79 and 81 is engaged with the presser portion 63 of the arm portion 53. Thus, the waveforms of ON-OFF outputs from between the depresser portion 81 and the presser portion 65 and from between the depresser portion 79 and the presser portion 63 are slightly different in terms of phase from one another.

On the contrary, and when the rotor 70 is rotated in the opposite direction (i.e., in the counter-clockwise direction), the timing in which the depresser portion 79 is engaged with the presser portion 63 of the arm portion 53 is slightly in advance to the timing in which the depresser portion 81 is engaged with the presser portion 65 of the arm portion 55.

Accordingly, it is possible to detect whether the rotor 70 is rotated in the clockwise direction or in the counter-clockwise direction by means of the phase difference of the waveform of the ON-OFF outputs from between the respective depresser portions and the presser portions.

Figure 6:
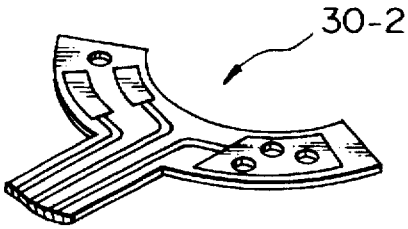
FIG. 6 is a perspective view showing a circuit substrate 30-2 to be employed in a second embodiment of the invention.

According to a second embodiment of the invention, the configuration of the circuit substrate 30 according to the first embodiment has been changed to the circuit substrate 30-2 shown in FIG. 6. The constructions of the remaining parts of the second embodiment are the same as those of the corresponding parts of the first embodiment. The thus modified circuit substrate 30-2 has a total area smaller than that of the circuit substrate 30 of the first embodiment.

As will be clear from the above embodiments, and in accordance with the invention, the abutment portions 59 and 61 of the elastic plate 50 are not slidably engaged with the switch contacts 37 and 39, but the former one resiliently engaged with and disengaged from the latter so as to perform switching operations between ON and OFF in a repeated manner. Accordingly, wearing of the abutment portions 59 and 61 and the switch contacts 37 and 39 is reduced, so that increased durability may be obtained.

The arm portions 53 and 55 of the elastic plate 50 are not always contacted or engaged with the depresser portions 79 and 81 of the rotor 70, whereby, normally, a no-load condition is maintained therebetween, and thus increased durability of the arm portions 53 and 55 may be obtained.

It is also noted that, in accordance with the invention, it is unnecessary for the circuit substrate to be formed with concentric common switch patterns, unlike the prior art rotary switch as explained in the BACKGROUND OF THE INVENTION. This also contributes to reduction in size of the rotary switch.

Although the rotary switches according to the first and second embodiments of the invention are exemplarily explained in the above as when they are used as an incremental encoder for two-phase output in which a pulse is generated at each predetermined angle of rotation when the rotor is rotated, the invention should not be limited to such an example. For example, the number or the configuration of the depresser portions and/or the arm portions may be variously changed, so that the rotary switches according to the invention may be utilized as a rotary switch for generating another type of waveform (for example, an absolute encoder for four-bit output).

Figure 7:
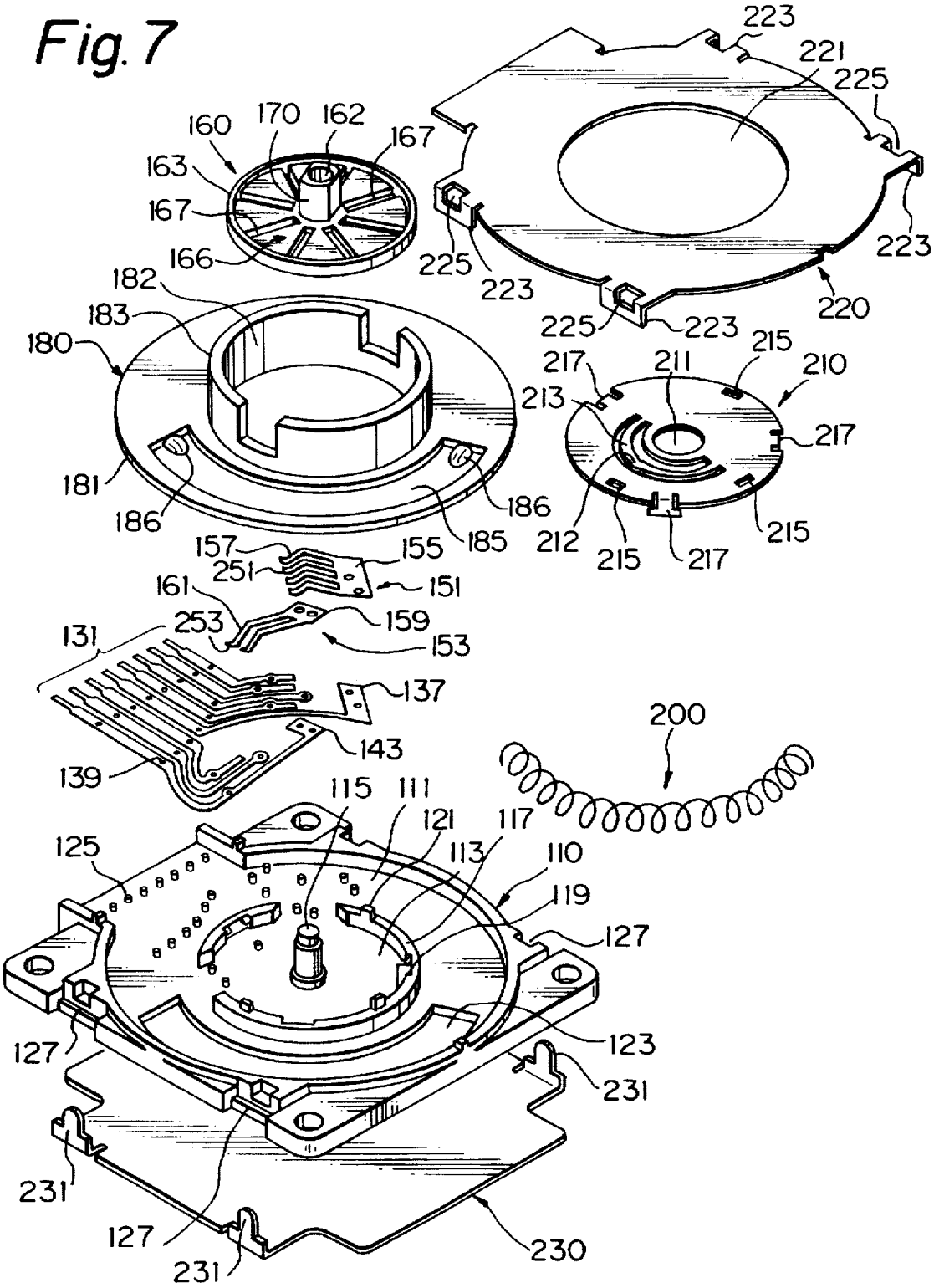
FIG. 7 is an exploded perspective view showing a rotary switch according to a third embodiment of the invention.

FIG. 7 is an exploded perspective view of a rotary switch according to a third embodiment of the invention. As shown in FIG. 7, the rotary switch includes a stationary member 110, eight metal plates 131, and two elastic plates 151 and 153. The metal plates 131 and the elastic plates 151 and 153 are fixed to the stationary member 110 so as to constitute a contact forming member. A first rotor 160 and a second rotor 180 are placed on the stationary member 110. A compression coil spring 200 is accommodated within an arcuate aperture 123 in the stationary member 110 and an arcuate aperture 185 in the second rotor 180. The first rotor 160 and the second rotor 180 are covered, at their upper ends, with first cover 210 and a second cover 220, respectively. An under cover 230 disposed below the stationary member 110 and the second cover 220 are fixedly connected with each other. Each of the above components will be explained below.

Figure 8:
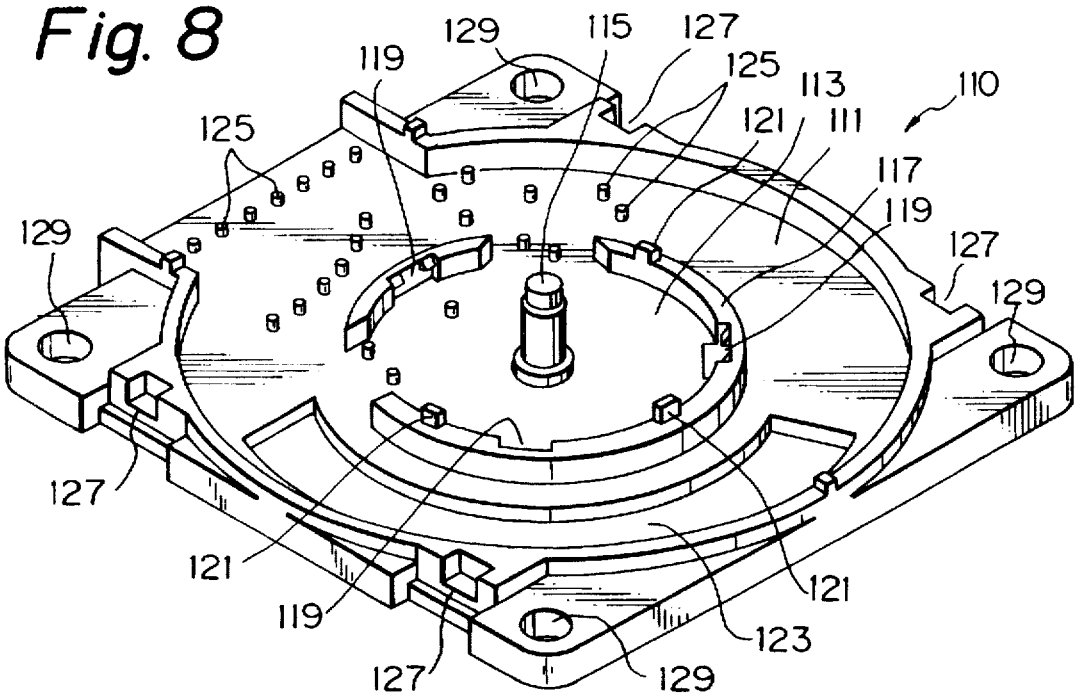
FIG. 8 is an enlarged perspective view of a base 110.

FIG. 8 is a perspective view illustrating the stationary member 110 in an enlarged scale. As shown in FIG. 8, the stationary member 110 is formed from synthetic resin material shaped into a substantially square configuration. The stationary member 110 includes an accommodation recess 111 of an annular configuration for receiving therein the second rotor 180, and an accommodation recess 113 of a circular configuration for receiving therein the first rotor 160.

A support shaft 115 is provided at the center of the accommodation recess 113 and protrudes in the upward direction. The accommodation recess 113 and the accommodation recess 111 are partitioned by an inner wall 117. Engagement portions 119 are provided at three positions in the inner peripheral surface of the inner wall 117. Each of the engagement portions includes a pawl for engagement with a respective engagement piece 217 (to be explained later) provided on the first cover 210. Three protrusions 121 are also formed in the upper surface of the inner wall 117.

Arcuate aperture 123 is provided in the accommodation recess 111. The arcuate aperture 123 arcately extends about 150 degrees around the support shaft 115.

A plurality of small projections 125 are formed on the surface of the accommodation recess 113 and on the accommodation recess 111 at predetermined positions.

A through-hole 129 is formed in the stationary member 110 at each of its four corners. The through-holes 129 are used in order to attach the rotary switch to another member. Four recesses 127 are provided in the outer periphery of the stationary member, these recesses being adapted to be engaged with respective pawls.

Figure 9:
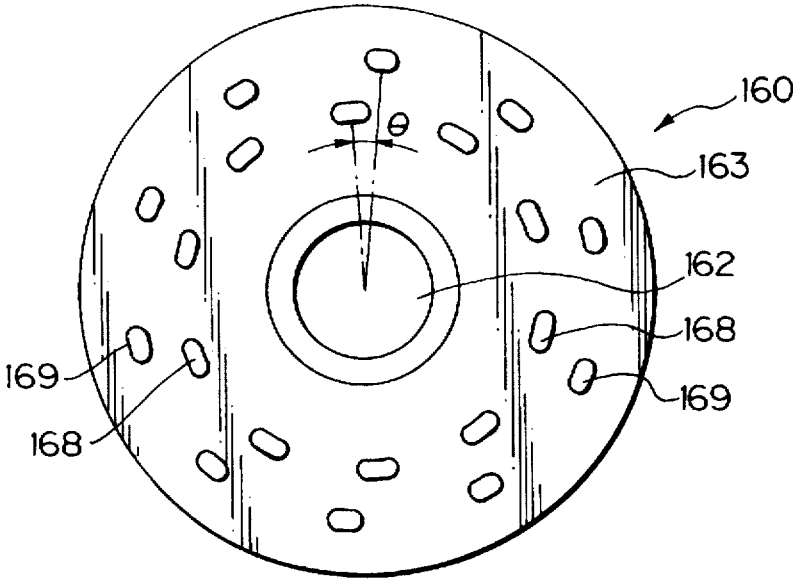
FIG. 9 is an enlarged rear view of a first rotor 160.

FIG. 9 is an enlarged rear view of the first rotor 160. As shown in FIGS. 7 and 9, the first rotor 160 includes a rotor body 163 of a substantially circular disk-shaped configuration and a rotation shaft (inner shaft) 170 at the center of the rotor body 163. A circular through-hole 162 is formed in the rotation shaft 170.

A plurality of recesses 167 are formed in the upper surface of the rotor body 163. The recesses 167 extend in the radial direction around the rotation shaft 170, so as to form a click surface 166 having recesses and protrusions.

Ten depresser portions 168 and ten depresser portions 169 on the form of protrusion are formed in the lower surface of the rotor body 163. The depresser portions 168 and the depresser portions 169 are equidistantly arranged on respective concentric circles. Every two adjacent depresser portions 168 and 169 are so arranged as to be shifted by a predetermined angle theta when viewed from the center of the rotor body 163.

Figure 10:
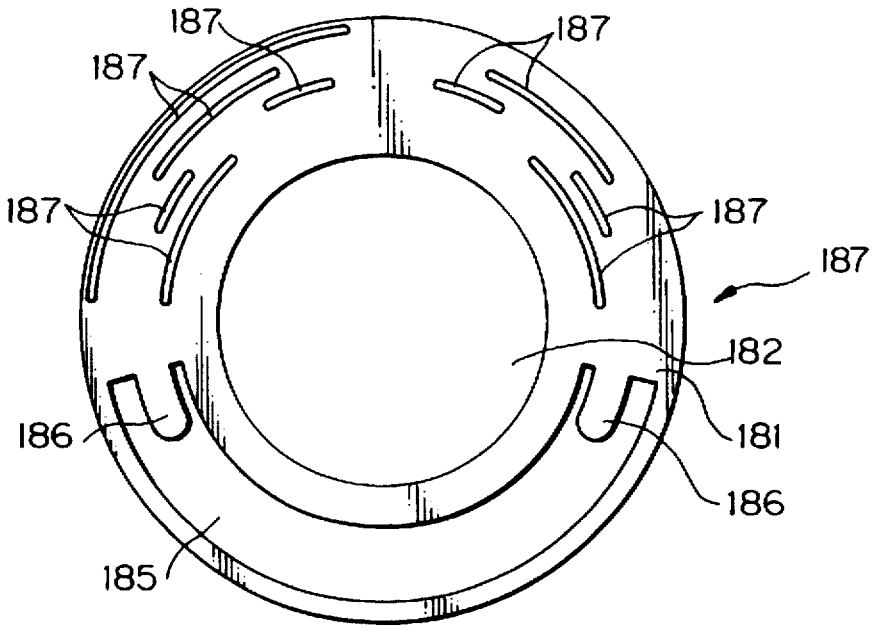
FIG. 10 is an enlarged rear view of a second rotor 180.

FIG. 10 is an enlarged rear view of the second rotor 180. As shown in FIGS. 7 and 10, the second rotor 180 includes a rotor body 181 of a substantially circular disk-shaped configuration. The rotor body 181 includes, at its center, a circular aperture 182 for receiving the first rotor 160. The rotor body 181 also includes a rotation shaft (outer shaft) 183 of a substantially cylindrical configuration extending around the aperture 182.

Arcuate aperture 185 is disposed outwardly of the rotation shaft 183 of the rotor body 181. The aperture 185 extends through the rotor body 181 and extends in the circumferential direction for 150 degrees. Support protrusions 186 are disposed on opposite ends of the arcuate aperture 185. The longitudinal length of the arcuate aperture 185 is the same as that of the arcuate aperture 123 provided in the stationary member 110.

Nine depresser portions 187 are protrudingly formed on the rear surface of the rotor body 181. The depresser portions 187 are arranged on four concentric circles and have respective predetermined lengths.

The first cover 210 includes, as shown in FIG. 7, a circular aperture 211, formed at the center of the cover 210 by punching a metal plate, for receiving the rotation shaft 170 of the first rotor 160, a click portion 213 of an arcuate configuration having a protrusion 212 protruding downwardly from the central portion of the click portion 213, three through-holes 215 for receiving therein the respective three protrusions 121 formed on the stationary member 110, and three engagement pieces 217 formed by downwardly bending the first cover 210 at three peripheral positions thereof for engagement with the respective three engagement portions 119 of the stationary member 110.

The second cover 220 includes, as shown in FIG. 7, a circular aperture 221 formed by punching a steel plate at its center for receiving therein the rotation shaft 183 of the second rotor 180, and engagement pieces 223 extending outwardly from the peripheral edge of the second cover 220 and bent in the downward direction. Each of the engagement pieces 223 includes a through-hole 225.

The lower cover 230 is formed by punching a metal sheet. The lower cover 230 includes, as shown in FIG. 7, four engagement pawls 231 (three of which are shown in FIG. 7) in its peripheral edge.

Figure 11:
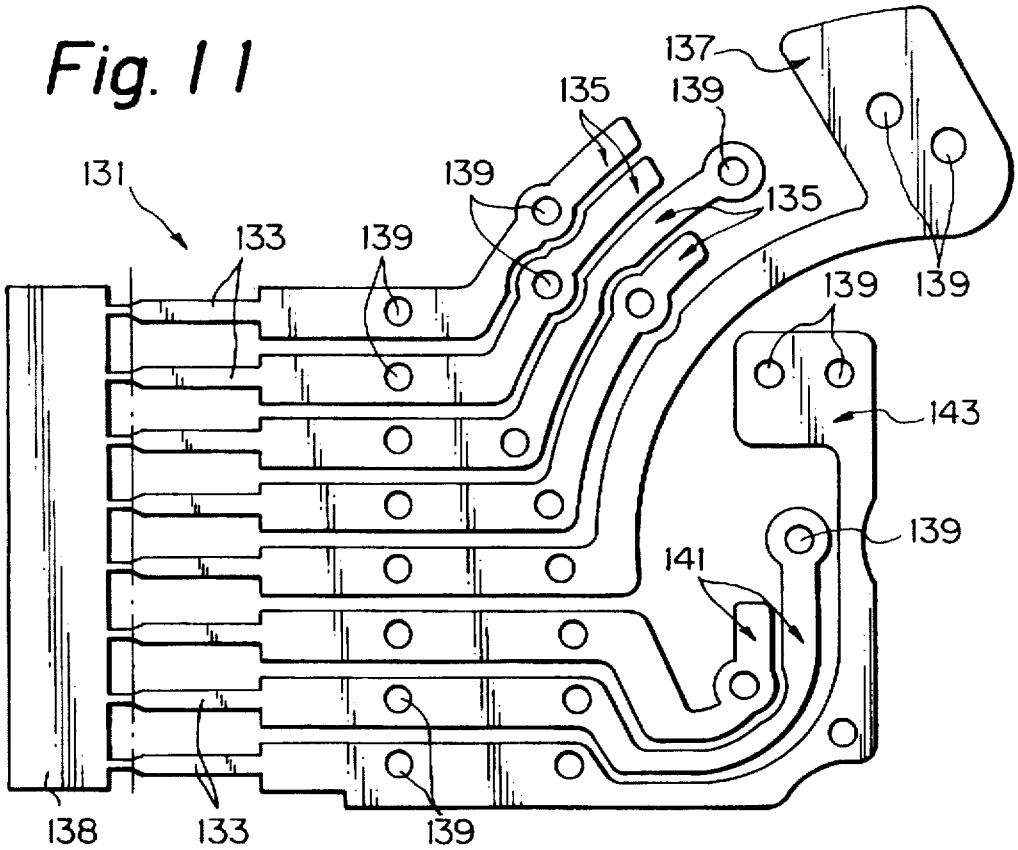
FIG. 11 is an enlarged plan view of a metal plate 131.

FIG. 11 is an enlarged view showing the eight metal plates 131. As shown in FIG. 11, the eight metal plates 131 are formed by punching a single metal plate. The eight metal plates 131 include terminal portions 133 at their ends extending outwardly therefrom. The terminal portions 133 are arranged in parallel relative to one another. Each terminal portion 133 is connected to a support plate 138. Each metal plate 131 is formed with a plurality of fixation apertures 139.

Each of the upper four metal plates 131 includes, at its one end, a switch contact 135 for engaging with a respective abutment portion 251 at the forward end of the arm portion 157 of the elastic plate 151 (to be explained later). The fifth (from the above) metal plate 131 includes, at its one end, a land contact 137 of a larger area to which a base portion 155 (to be explained later) of the elastic plate 151 is attached.

The sixth and seventh (from the above) metal plates 131 include, at their one ends, a switch contact 141 for engaging with a respective abutment portion 253 at the forward end of the arm portion 161 of the elastic plate 153. The lower-most metal plate 131 includes, at its one end, a land contact 143 of a larger area to which a base portion 159 of the elastic plate 153 is attached.

Figure 12A:
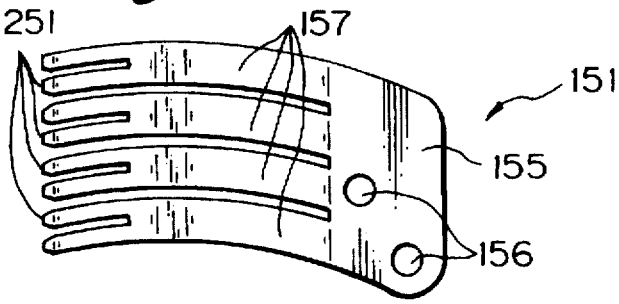
FIG. 12(A) is an enlarged plan view of an elastic plate 151.
Figure 12B:
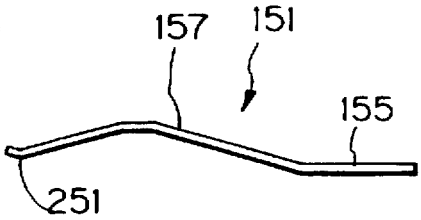
FIG. 12(B) is an enlarged side elevational view of the elastic plate 151.
Figure 12C:
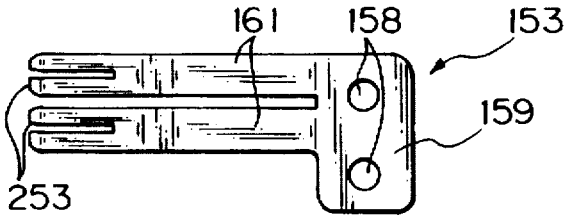
FIGS. 12(C) and 12(D) are similar views of an elastic plate 153.
Figure 12D:
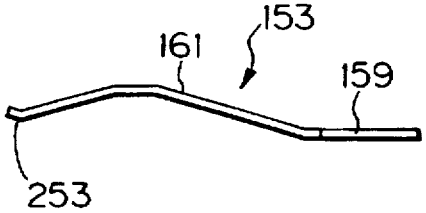

FIGS. 12(A) and 12(B) show the elastic plate 151. FIGS. 12(C) and 12(D) show the elastic plate 153. Each of the elastic plates 151 and 153 is formed by punching an elastic metal plate. The elastic plate 151 includes four arm portions 157 extending from its base portion 155. The elastic plate 153 also includes two arm portions 161 extending from its base portion 159. Each of the arm portions 157 and 161 is bent at its substantially central portion so as to form an upwardly convexed portion. The base portion 155 includes two fixation apertures 156. The base portion 159 includes two fixation apertures 158. The forward end of each of the arm portions 157 and 161 constitutes an abutment portion 251, 253 for engagement or abutment with the switch contacts 135, 141.

When the rotary switch is assembled, the stationary member 110 is first placed on the eight metal plates 131 shown in FIG. 11, as shown in FIG. 7. At this time, the small protrusions 125 on the stationary member 110 are received in the respective fixation apertures 139 in the metal plates 131.

Figure 15:
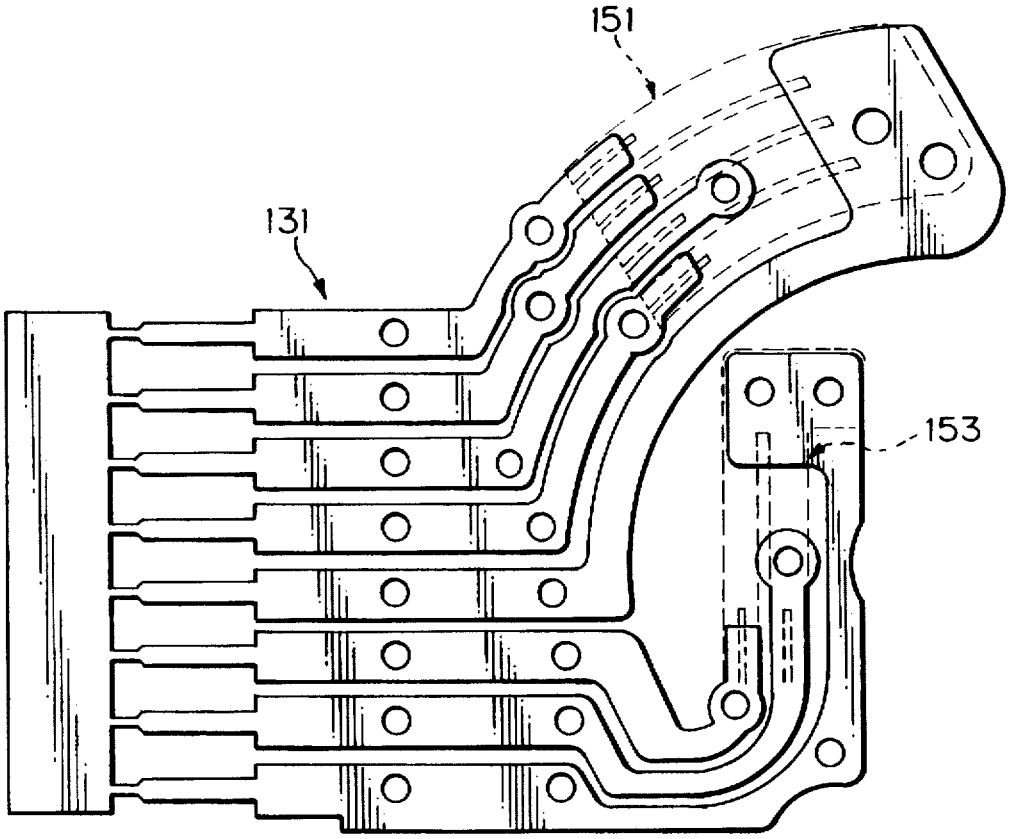
FIG. 15 is a view illustrating a positional relationship between the metal plate 131 and the elastic plates 151, 153.

Then, the base portions 155 and 159 of the two elastic plates 151 and 153 are placed on the respective land contacts 137 and 143 of the metal plates 131. At this time, the small protrusions 125, having passed through the fixations apertures 139 in the land contacts 137 and 143, are received in the fixation apertures 156 and 158 in the base portions 155 and 159. FIG. 15 illustrates how the metal plates 131 are attached to the elastic plates 151 and 153.

Then, the forward end of each of the small protrusions 125 is heat-crimped, so that each of the metal plates 131 and the elastic plates 151 and 153 are fixed to the stationary member 110. At the same time, the land contacts 137 and 143 of the metal plates 131 and the base portions 155 and 159 of the elastic plates 151 and 153 are electrically connected, respectively. In this regard, it should be noted that the abutment portions 251 at the forward ends of the four arm portions 157 of the elastic plate 151 are spaced upwardly a predetermined distance from the respective four switch contacts 135 of the metal plates 131. The abutment portions 253 at the forward ends of the two arm portions 161 of the elastic plate 153 are spaced upwardly a predetermined distance from the respective two switch contacts 141 of the metal plates 131 (see FIG. 15).

The support plate 138 is cut away along the single-dot line in FIG. 11 from each metal plate 131.

Then, the stationary member 110 is placed on the lower cover 230. Subsequently, the first rotor 160 is placed within the accommodation recess 113 of the stationary member 110, and the second rotor 180 is placed within the accommodation recess 111. By this, the support shaft 115 of the stationary member 110 is inserted within the through-hole 162 of the first rotor 160 for pivotal movement. At the same time, the inner wall 117 of the stationary member 110 is inserted within the aperture 182 of the second rotor 180 and supported for pivotal movement.

Then, the first cover 210 is placed over the first rotor 160 and urged downwardly so that the first cover 210 is sealingly engaged with the upper surface of the inner wall 117 of the stationary member 110. By this, the engagement piece 217 are lockingly engaged with the engagement portions 119 of the stationary member 110. At this time, the protrusions 121 are inserted into the through-holes 215. Then, the forward ends of the protrusions 121 are heat-crimped.

Then, the arcuate aperture 185 of the second rotor 180 is aligned with the arcuate aperture 123 of the stationary member 110. The compression coil spring 200 is inserted into the aligned apertures 185 and 123. At this time, the opposite ends of the compression coil spring 200 are fitted over the respective support protrusions 186 formed on the second rotor 180, so that the coil spring 200 may be supported by the protrusions 186. By this, the opposite ends of the compression coil spring 200 are resiliently engaged with the opposed end surfaces of the arcuate apertures 123 and 185.

Then, the second cover 220 is placed on the second rotor 180 and the second rotor 180 is urged against the upper surface of the stationary member 110. By this, the four engagement pieces 223 of the second cover 220 are inserted into the respective recesses 127 of the stationary member 110.

Then, the engagement pawls 231 of the lower cover 230 are bent so as to be engaged within the respective through-holes 225, whereby the rotary switch is completed.

Figure 13:
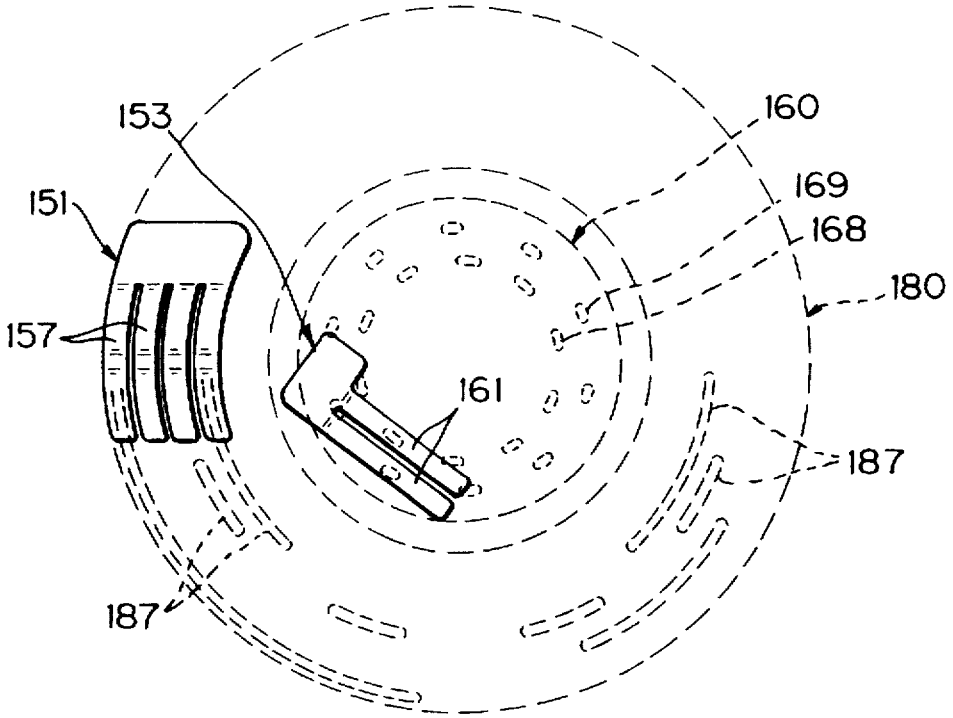
FIG. 13 is a view illustrating a positional relationship between the elastic plates 151, 153 and depresser portions 168, 169.
Figure 14:
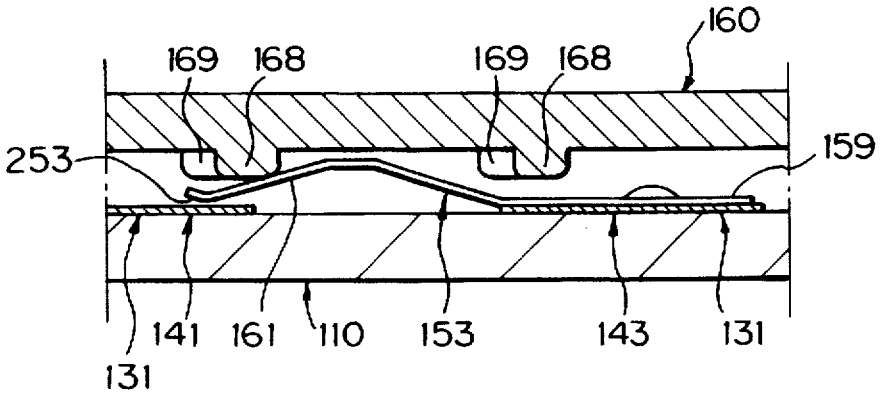
FIG. 14 is a view illustrating a positional relationship between the elastic plates 153 and the depresser portions 168, 169.

Operation of the rotary switch will be explained below. FIG. 13 is a schematic view illustrating a positional relationship between the elastic plates 151 and 153 and the depresser portions 168 and 169 of the first rotor 160 and the depresser portions 187 of the second rotor 180. FIG. 14 is a schematic view illustrating a positional relationship between the elastic plate 153 and the depresser portions 168 and 169 of the first rotor 160.

When the rotation shaft 170 of the first rotor 160 shown in FIG. 7 is rotated, the depresser portions 168 and 169 formed in the lower surface of the rotor 160 are also rotated. The depresser portions 168 and 169 are respectively engaged with the convexed portions at the central portions of the two arm portions 161 of the elastic plate 153 secured to the stationary member 110, as shown in FIGS. 13 and 14.

Each arm portion 161, which is depressed by the depresser portions 168 or 169, is inclined downwardly in its entirety, so that the abutment portion 253 at the forward end of the arm portion 161 is engaged with the switch contact 141 of the metal plate 131. Thus, the metal plate 131 having the switch contact 141 and the metal plate 131 having the land contact 143 are electrically connected with each other, so that a corresponding signal may be obtained.

It should be noted that, since the corresponding or adjacent depresser portions 168 and 169 are shifted a predetermined angle of theta relative to one another, the positions at which the depresser portions 168 and 169 depress the respective arm portions 161 are shifted. That is to say, ON-OFF timing is not the same. By this, a desired switch signal (2-bit) is obtained from the first rotor 160.

When the first rotor 160 is rotated, the protrusion 212 of the first cover 210 is engaged with the click surface 166 shown in FIG. 7, whereby click feeling may be obtained at the first rotor 160.

When the second rotor 180 is rotated, the compression coil spring is compressed and the depresser portions 187 concentrically arranged at the lower surface of the second rotor 180 are simultaneously rotated. By this, the depresser portions 187 are respectively engaged with the convexed portions at the central portion of each of the four arm portions 157 of the elastic plate 151, as shown in FIG. 13.

Each arm portion 157, which is depressed by the respective depresser portion 187, is inclined downwardly, so that the abutment portion 251 at the forward end of the arm portion 157 is engaged with the switch contact 135 (see FIG. 11) of the respective metal plate 131, whereby the metal plate 131 having the switch contact 135 and the metal plate 131 having the land contact 137 are electrically connected with each other.

Since the positions of the protrusions 187 are shifted relative to one another, each signal is different depending upon the rotational angle of the second rotor 180. By this, a desired switch signal (4-bit) may be obtained from the second rotor 180.

When the operator releases his hand from the second rotor 180, the second rotor 180 is automatically returned to its original position by means of a resilient force of the compression coil spring 200 shown in FIG. 7.

It is noted that, according to the above third embodiment, the elastic plates 151 and 153 and the switch contacts 135 and 141 of the metal plates 131 are not slidable engaged, but they are resiliently engaged and disengaged in a repetitive manner so as to be switched ON and OFF. Thus, wearing of the elastic plates 151 and 153 and the switch contacts 135 and 141 is reduced, to that their durability may be increased.

The arm portions 157 and 161 of the elastic plates 151 and 153 are not always depressed. Thus, they are normally maintained at no-load condition, so that durability of the arm portions 157 and 161 are increased.

Figure 18:
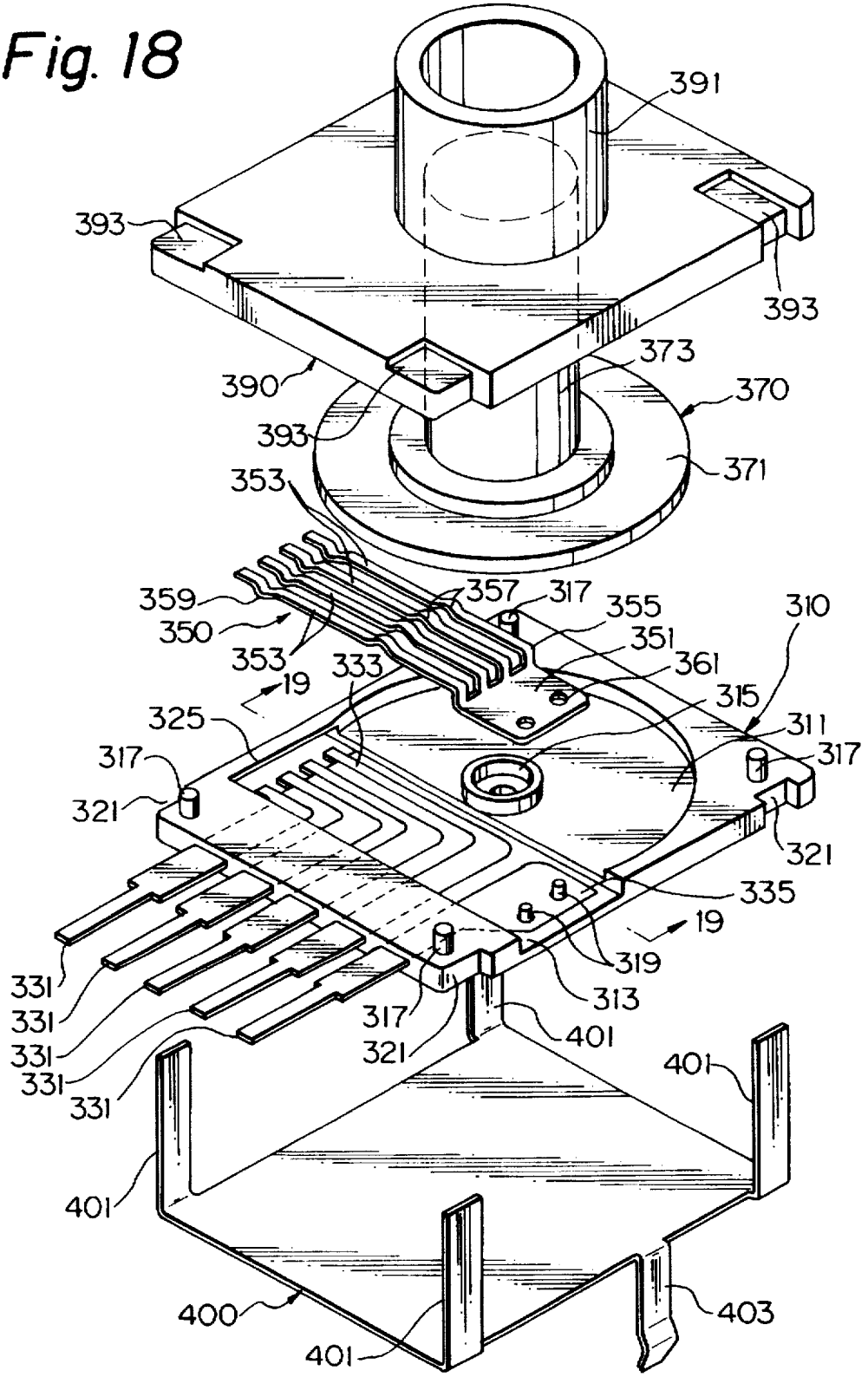
FIG. 18 is an exploded perspective view of the rotary switch according to the fourth embodiment of the invention.

FIG. 18 is an exploded perspective view illustrating a rotary switch according to a fourth embodiment of the invention. As shown in FIG. 18, the rotary switch includes a contact forming member 310 integrally formed with five metal plates 331, an elastic plate 350, a rotor 370, an upper case 390, and an attachment plate 400. The above components will be explained in detail below.

Figure 19:
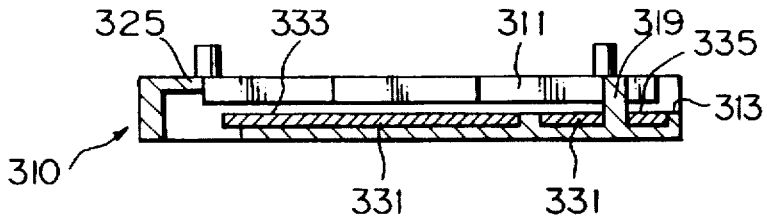
FIG. 19 is a sectional view along line 19—19 of FIG. 18 showing a contact forming member 310.
Figure 20:
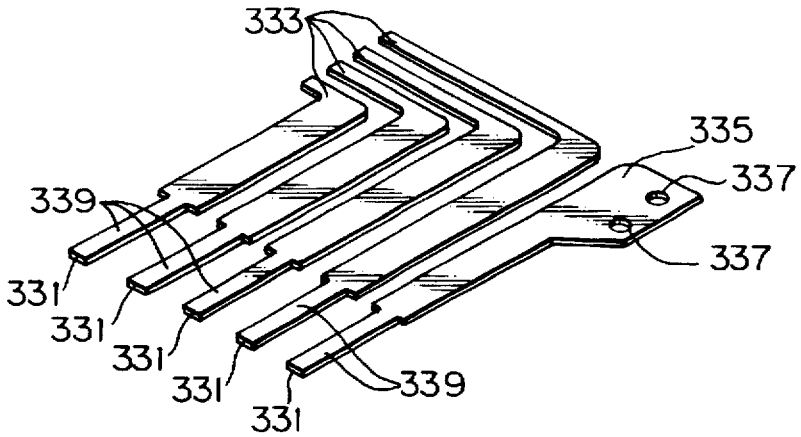
FIG. 20 is an enlarged perspective view showing a metal plate 331.

FIG. 19 is a cross-sectional view of the contact forming member 310 shown in FIG. 18. FIG. 20 is a perspective view illustrating the metal plates 331 which are embedded in a moldable resin. It is noted that, in the fourth embodiment, the moldable resin in which the metal plates 331 are embedded constitutes the stationary member.

As shown in FIG. 20, four of the five metal plates 331 are bent into a substantially L-shaped configuration in the same direction. Each of the four metal plates 331 includes a switch contact 333 at a position proximate to its forward end.

The remaining one metal plate 331 includes a land contact 335 at its forward end. The land contact 335 includes two through-holes 337. The other end of each of the five metal plates 331 forms a terminal portion 339.

The contact forming member 310 is constituted, as shown in FIGS. 18 and 19, by molding the metal plates 331 integrally with the moldable resin. The contact forming member 310 has a configuration of a substantially rectangular, flat plate. The contact forming member 310 includes at its central portion a recess 311 of a semi-circular configuration for accommodating therein rotor 370 which will be explained below. The contact forming member 310 also includes a mounting portion 313 for the metal plates 331 to which the metal plates 331 are mounted in an exposed fashion.

A bearing portion 315 of a recessed configuration is formed at the central portion of the recess 311. The bearing portion 315 is adapted to rotatably receive a bearing protrusion 375 of the rotor 370 which will be explained below. Engagement protrusions 317 are formed in the upper surface of the contact forming member 310 at the four corners thereof.

A small protrusion 319 extends through each of the two through-holes 337 in the land contact 335 from the metal plate mounting portion 313.

The upper surface of each of the five metal plates 331 is exposed from the surface of the metal plate mounting portion 313.

An engagement flange or rod 325 is disposed above the forward ends of the switch contacts 333 of the metal plates 331 and extends over the surface of the metal plate mounting portion.

A notch 321 is formed in the side surface at each corner of the contact forming member 310. Each of the notches 321 is adapted to receive a respective engagement piece 401 of the mounting plate 400.

The elastic plate 350 is made by press-forming a single sheet or plate of elastic metal, as shown in FIG. 18. Four arm portions 353 are extended from a base portion 351 of a rectangular configuration at one end of the elastic plate 350. The arm portions 353 are arranged in parallel relative to one another and form a tooth-like configuration.

Each of the four arm portions 353 includes a bent portion 355, through which the arm portion is connected to the base portion 351, so that the surface of the arm portion is at a predetermined level above the surface of the base portion 351.

The four arm portions 353 are formed into a linear configuration of the same length. Each arm portion 353 includes, at its central portion, a presser protrusion 357 of a semi-circular configuration which is curved in the upward direction. Each arm portion 353 also includes, at its forward end, an abutment portion 359 of a semi-circular configuration which is curved in the downward direction. The base portion 351 includes two through-holes 361.

Figure 21A:
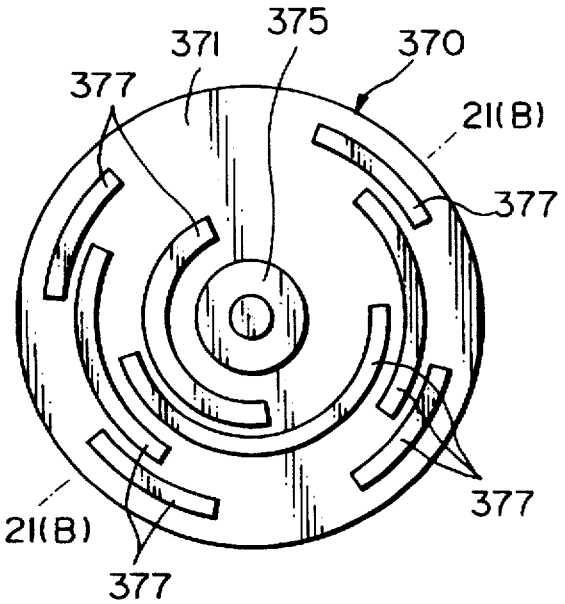
FIG. 21(A) is a bottom view of the rotor 370.
Figure 21B:
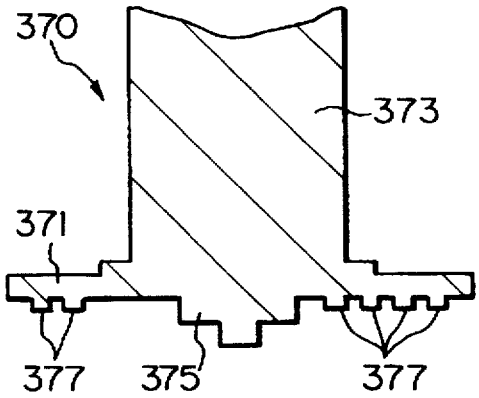
FIG. 21(B) is a side elevational view in section along line 21(B)—21(B) of FIG. 21(A) showing the rotor 370.

FIG. 21(A) is a bottom view and FIG. 21(B) is a side elevational view in section of the rotor 370.

As shown in FIGS. 18 and 21(A) and 21(B), the rotor 370 includes a rotor body 371 of a disk-like configuration and a knob portion 373 of a cylindrical configuration extending from the upper surface of the rotor body 371 at its central portion. Bearing protrusion 375 is provided in the lower surface of the rotor body 371 at its central portion. The bearing protrusion 375 is configured to be rotatably received in bearing portion 315 of the contact forming member 310. The rotor body also includes eight depresser portions 377 protruding in an arcuate manner. The depresser portions 377 are disposed on different concentric circles about the bearing protrusion 375 (one on each of two inner circles, two on the next circle, and four on the outer-most circle).

The pitches between the four different circles are the same as those between the above four arm portions 353.

The upper case 390 is a metal member and has a configuration of a substantially flat plate, as shown in FIG. 18. The upper case 390 includes a cylindrical protrusion 391 extending from its upper surface at the center thereof, an engagement recess 393 in its upper surface at each of four corners thereof, and a circular recess 395 (see FIG. 16) in the lower surface at its center for receiving therein the rotor body 370 of the rotor 370. An engagement hole (not shown) is provided in the lower surface of the upper case 390 at each of its four corners. The engagement holes are adapted to receive therein the respective engagement protrusions 317 of the contact forming member 310 for positioning of the contact forming member.

The mounting plate 400 is a metal plate of substantially flat-plate configuration and includes, as shown in FIG. 18, four engagement pieces 401 extending upwardly from the four corners of the metal plate. Reference numeral 403 designates a fixation protrusion for securing the rotary switch to another member.

When it is intended to produce the rotary switch, first, the forward ends of the arm portions 353 of the elastic plate 350 are placed below the engagement rod 325, and the two small protrusions 319 of the contact forming member 310 are inserted into the respective two through-holes 361 in the elastic plate 350. Then, the forward ends of the protrusions 319 are heat-crimped, whereby the base portion 351 of the elastic plate 350 is pressingly connected to the land contact 335 of the metal plate 331, so as to mechanically secure and electrically connect the base portion 351 and the land contact together.

At this time, the abutment portion 359 of each of the four arm portions 353 of the elastic plate 350 is spaced a predetermined gap above the switch contact 333 of each of the metal plates 331.

Figure 22:
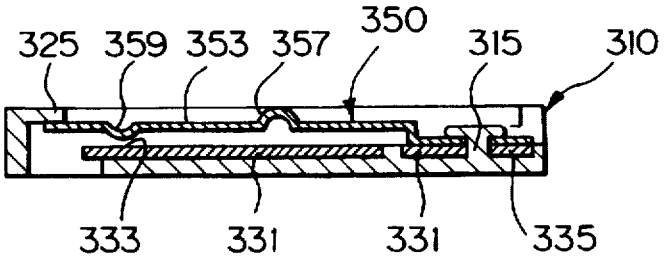
FIG. 22 is a side elevational view in section showing the contact forming member 310 to which the elastic plate 350 is attached.

FIG. 22 is a side elevational view in section of the contact forming member 310 to which the elastic plate 350 is mounted (FIG. 22 shows a section the same as that of FIG. 19). As shown in FIG. 22, the forward end of each of the arm portions 353 of the elastic plate 350 is resiliently urged against lower surface of the engagement rod 325 of the contact forming member 310, so that the arm portions 353 are not moved upwardly from the engagement rod 325.

Reverting now to FIG. 18, the contact forming member 310 is placed on the mounting plate 400. Then, the rotor body 371 of the rotor 370 is received in the recess 311 of the contact forming member 310. The upper case 390 is placed on the contact forming member 310. By this, the knob portion 373 of the rotor 370 is extended through the cylindrical protrusion 391 of the upper case 390.

Then, the four engagement pieces 401 of the mounting plate 400 are bent onto the upper surface of the upper case 390, so as to be engaged with the respective engagement recesses 393, whereby the rotary switch is completed.

Figure 16:
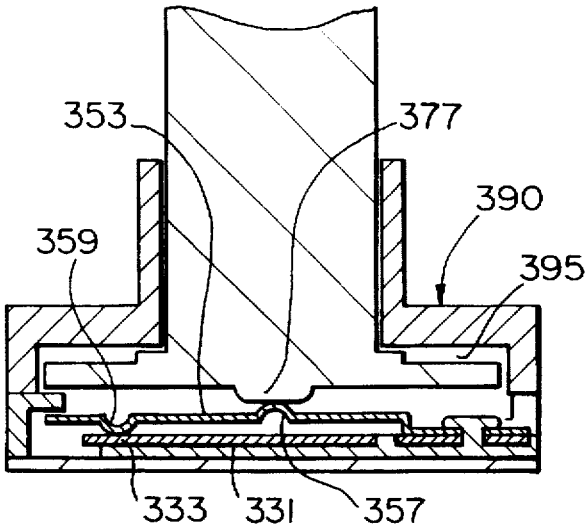
FIG. 16 is a schematic side elevational view in section of a rotary switch according to a fourth embodiment of the invention.
Figure 17:
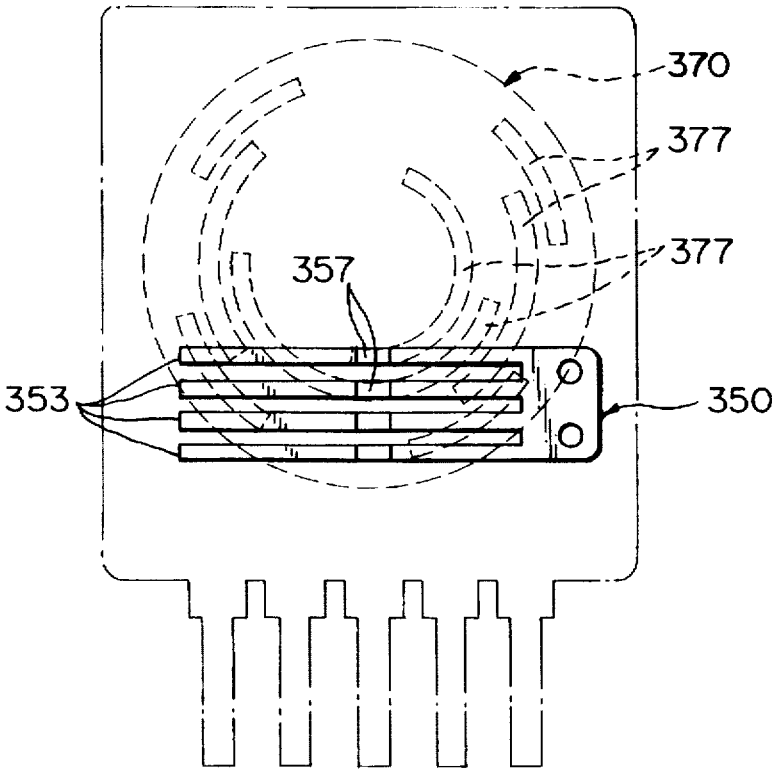
FIG. 17 is a view illustrating a positional relationship between a depresser portion 377 of a rotor 370 and an elastic plate 350.

FIG. 16 is a schematic view in section of the thus assembled rotary switch. FIG. 17 is a view illustrating a positional relationship between the depresser portions 377 of the rotor 370 within the rotary switch and the elastic plate 350.

In FIG. 17, the depresser portions 377 of the rotor 370 disposed on the inner-most concentric circle and the depresser portions 377 disposed on the next inner-most concentric circle are engaged with presser protrusions 357 provided on the upper two arm portions 353 of the elastic plate 350. By this, the above two arm portions 353 are depressed downwardly, as shown in FIG. 16, and their abutment portions 359 are engaged with the oppositely disposed respective switch contacts 333 of the two metal plates 331 (FIG. 18). By this, the metal plates 331 having the land contact 335 which is common to the above two metal plates 331 are electrically connected.

When the rotor 370 shown in FIG. 17 is rotated, for example, in the clockwise direction, the fourth arm portion 353 from above is depressed and engaged with the corresponding metal plate 331. Then, the third arm portion 353 from above is depressed and engaged with the corresponding metal plate 331. Subsequently, the fourth arm portion 353 from above is returned to its original position and disengaged from the corresponding metal plate 331, and then second arm portion 353 from the above is returned to its original position and disengaged from the corresponding metal plate 331. Accordingly, a desired switch signal of 4bit may be obtained by adjusting the position and/or the length of the depresser portions 377.

In the fourth embodiment, the forward end of each of the arm portions 353 of the elastic plate 350 is engaged with the engagement rod 325 of the contact forming member 310, so that the arm portions 353 are not moved upwardly from the engagement rod 325, as shown in FIG. 22. This construction is employed in order to maintain the switch contacts 333 and the abutment portions 359 to be spaced at a predetermined distance, so as to assure precise or secure ON-OFF switching operation.

If the engagement rod 325 is not provided, the forward end of each of the arm portions 353 would be moved upwardly to a substantial degree. If this occurs, the depresser portions 377 of the rotor 370 would become engaged with the raised side edges of the arm portions 353, so that the arm portions 353 might be damaged. The above mentioned construction also contributes to prevent such inconvenience.

In the fourth embodiment, like the another embodiments, the abutment portions 359 of the elastic plate 350 and the switch contacts 333 of the switch plate 330 are not slidably engaged relative to one another, but they simply repeatedly are resiliently engaged and disengaged, so as to be switched ON and OFF. Thus, wearing of the abutment portions 359 and the switch contacts 333 may be reduced, whereby their durability is increased.

The invention may be carried out in various ways without departing from the spirit and main features of the invention. Accordingly, the above-mentioned embodiments should be merely construed as illustrative, and should not be interpreted as restrictive in any respect. The scope of the invention is defined in the appended claim and is not limited by the description of the body of the specification. Any changes, modifications and equivalents within the purview of the claims should be covered.

What is claimed is:

1. A rotary switch comprising:

a contact forming member including a plurality of switch contacts and one land contact;

an elastic plate including one base portion mounted on said one land contact, a plurality of arm portions protruding from said one base portion, and abutment portions disposed at predetermined positions on said arm portions opposite respective said switch contacts;

a rotor disposed in spaced relation to said elastic plate for rotary movement and including depressor portions for individually depressing respective said arm portions of said elastic plate;

wherein when said rotor is rotated, said depressor portions of said rotor cause respective said arm portions of said elastic plate to be individually depressed, so that said abutment portions of said arm portions are individually engaged with respective said switch contacts; and wherein each of said plurality of switch contacts and said one land contact comprises a planar metal plate having a terminal portion at an end thereof extending outwardly therefrom, said contact forming member is constructed by securing said plurality of switch contacts and said one land contact to a stationary member, and said one base portion of the elastic plate has a planar form and is fixed on said one land contact by surface contact.

2. A rotary switch comprising:

a contact forming member including a plurality of switch contacts and one land contact;

an elastic plate including one base portion mounted on said one land contact, a plurality of arm portions protruding from said one base portion, and abutment portions disposed at predetermined positions on said arm portions opposite respective said switch contacts;

a rotor disposed in spaced relation to said elastic plate for rotary movement and including depressor portions for individually depressing respective said arm portions of said elastic plate;

wherein when said rotor is rotated, said depressor portions of said rotor cause respective said arm portions of said elastic plate to be individually depressed, so that said abutment portions of said arm portions are individually engaged with respective said switch contacts;

where each of said plurality of switch contacts of said one land contact comprises a planar metal plate having a terminal portion at an end thereof extending outwardly therefrom and said contact forming member is constructed by securing said plurality of switch contacts and said one land contact to a stationary member; and wherein said elastic plate includes two arm portions, and said depressor portions for depressing a first said arm portion and said depressor portions for depressing a second said arm portion are equal in number, and each said depressor portion for depressing said first arm portion and an adjacent said depressor portion for depressing said second arm portion have the same form and are arranged so as to be slightly shifted by a predetermined amount relative to each other in a direction of rotation of said rotor.

3. A rotary switch comprising:

a contact forming member including a plurality of switch contacts and one land contact;

an elastic plate including one base portion mounted on said one land contact, a plurality of arm portions protruding from said one base portion, and abutment portions disposed at predetermined positions on said arm portions opposite respective said switch contacts;

a rotor disposed in spaced relation to said elastic plate for rotary movement and including depressor portions for individually depressing respective said arm portions of said elastic plate;

wherein when said rotor is rotated, said depressor portions of said rotor cause respective said arm portions of said elastic plate to be individually depressed, so that said abutment portions of said arm portions are individually engaged with respective said switch contacts;

wherein said elastic plate includes two arm portions, and said depressor portions for depressing a first said arm portion and said depressor portions for depressing a second said arm portion are equal in number, and each said depressor portion for depressing said first arm portion and an adjacent said depressor portion for depressing said second arm portion have the same form and are arranged so as to be slightly shifted by a predetermined amount relative to each other in a direction of rotation of said rotor.

4. A rotary switch comprising:

a contact forming member including a plurality of switch contacts and one land contact;

an elastic plate including one base portion mounted on said one land contact, a plurality of arm portions protruding from said one base portion, and abutment portions disposed at predetermined positions on said arm portions opposite respective said switch contacts;

a rotor disposed in spaced relation to said elastic plate for rotary movement and including depressor portions for individually depressing respective said arm portions of said elastic plate;

wherein when said rotor is rotated, said depressor portions of said rotor cause respective said arm portions of said elastic plate to be individually depressed, so that said abutment portions of said arm portions are individually engaged with respective said switch contacts; and wherein each of said arm portions has a rectilinear configuration, said arm portions extend parallel to each other in a direction tangential to a direction of rotation of said rotor, each of said arm portions includes a presser protrusion to be depressed by respective said depressor portions of said rotor, said presser protrusions being spaced radially relative to said rotor, and an upper surface of a forward end of each of said arm portions is urged against an engaging member, so that upward movement of said arm portions is restricted.

* * * * *